United States Patent [19]

Nakada et al.

[11] 4,235,142

[45] Nov. 25, 1980

[54] ELECTRONIC MUSICAL INSTRUMENT OF TIME-SHARED DIGITAL PROCESSING TYPE

[75] Inventors: Akira Nakada; Eiichiro Aoki; Akiyoshi Oya; Takatoshi Okumura; Yasuji Uchiyama; Eiichi Yamaga, all of Hamamatsu, Japan

[73] Assignee: Nippon Gakki Seizo Kabushiki Kaisha, Hamamatsu, Japan

[21] Appl. No.: 904

[22] Filed: Jan. 4, 1979

[30] Foreign Application Priority Data

Jan. 12, 1978 [JP] Japan ..... 53-2215

[51] Int. Cl.[3] ..... G10H 1/00

[52] U.S. Cl. ..... 84/1.03; 84/1.24

[58] Field of Search ..... 84/1.01, 1.03, 1.24, 84/DIG. 12

[56] References Cited

U.S. PATENT DOCUMENTS

| | | | |
|---|---|---|---|
| 3,842,184 | 10/1974 | Kniepkamp et al. | 84/1.24 |
| 3,986,423 | 10/1976 | Rossum | 84/1.01 |
| 4,031,786 | 6/1977 | Kaplan | 84/1.03 |
| 4,041,825 | 8/1977 | Pascetta | 84/1.01 |
| 4,054,078 | 10/1977 | Kondo | 84/1.24 |
| 4,106,385 | 8/1978 | Roberts | 84/1.01 |
| 4,154,131 | 5/1979 | Studer et al. | 84/1.03 |
| 4,158,978 | 6/1979 | Hiyoshi et al. | 84/1.03 |
| 4,184,401 | 1/1980 | Hiyoshi et al. | 84/1.03 |

*Primary Examiner*—Stanley J. Witkowski
*Assistant Examiner*—Forester W. Isen
*Attorney, Agent, or Firm*—Spensley Horn Jubas & Lubitz

[57] ABSTRACT

An electronic musical instrument is of a time-shared digital processing type and capable of producing musical tones for a special performance. There are provided, at suitable time intervals, time periods in which no key code of a depressed key is produced by a key coder. During these time periods, a signal designating a special performance is generated. In a channel assignment circuit which assigns key codes of depressed keys to plural tone production channels there is provided a channel for an exclusive use for the special performance. A circuit for assigning data for the special performance transmits the data to the channel assignment circuit in response to the special performance designation signal from the key coder so that the data selected from among the key data already assigned to the tone production channels for ordinary performance are sequentially assigned to the channel allotted exclusively for the special performance. As an example of the special performance, description is made with respect to an automatic arpeggio performance in which tones are produced at designated orders of location from the lowest tone among the tones of the depressed keys.

4 Claims, 7 Drawing Figures

FROM KEY CODE MEMORY 17
COMPARATOR
NOTE COUNTER
ARPEGGIO REGISTER
TO KEY CODE MEMORY 17
ADDER
COUNTER
(UP/DOWN)
RESET
TURN
UP
ARPEGGIO PATTERN REGISTER
COMPARATOR
TONE NUMBER COUNTER
COUNTER
RESET
COUNT
LKM
LKO
COIN
CON
APL
AEQ
CARY
ART
ARP
UT

ELECTRONIC MUSICAL INSTRUMENT OF TIME-SHARED DIGITAL PROCESSING TYPE

BACKGROUND OF THE INVENTION

This invention relates to an electronic musical instrument capable of producing special performance effects such for instance as an automatic arpeggio performance. Known in the art of electronic musical instruments is one in which a predetermined number of tone production channels are provided, data as to depressed keys are assigned to respective tone production channels by digital technique, and plural tones are produced simultaneously through these tone production channels. In this type of electronic musical instrument, arrangements are made for preventing assignment of one and the same tone to plural tone production channels. An electronic musical instrument of this type, which is modified to carry out special performances such as an automatic arpeggio performance and an automatic bass performance is described in the U.S. Pat. No. 4,158,978 entitled "Electronic musical instrument" or in the U.S. Pat. application Ser. No. 825,443, now U.S. Pat. No. 4,184,401, entitled "Electronic musical instrument with automatic bass chord performance device" both assigned to the same assignee as the present case. The former patent relates to an electronic musical instrument adapted to perform a kind of automatic arpeggio performance. In this instrument, one or more tones are produced one after another with a predetermined time interval by assigning tone production for one or more keys depressed in the keyboard separately to one or more tone production channels and thereafter controlling timing of tone production in the respective channels. Accordingly, tone production of depressed keys is not always made in the tone production channels to which tone production of the keys depressed for the automatic arpeggio performance has been assigned, but tone production is made in only one channel selected in accordance with the tone production timing control, and this tone production channel in which tone production is actually made is switched from one channel to another. Since the number of the tone production channels is limited (e.g. 12), if the number of the keys depressed for the automatic performances increases, the number of the channels which are available for an ordinary tone production decreases, which is a disadvantage of this type of instrument.

The latter application mentioned above relates to an instrument capable of conducting an automatic bass performance in which data of a key depressed in the keyboard is modified by a calculating operation before the key data is assigned to a tone production channel and a tone corresponding to the modified key data is assigned to a tone production channel. According to this type of instrument, however, a tone corresponding exactly to the depressed key cannot be produced with a result that a free performance in the electronic musical instrument is hampered.

It has been a general tendency in the automatic arpeggio performance conducted by prior art electronic musical instruments including the above described instruments to selectively control timing of production of tones for depressed keys so that production of tones corresponding exactly to the depressed keys is cancelled when the automatic performance is being made. Further, it is common in the prior art instruments to designate a tone constituting a basic tone for the automatic performance directly from the keyboard. In this case, the keyboard does not perform its proper function of manual key selection means for a manual operator any longer but serves merely as an auxiliary means for an automatic performance (e.g. means for designating a root note or a chord or means for designating arpeggio constituting tones).

In prior art electronic musical instruments before the above described United States patent applications, it was customary to conduct the automatic performance by an independent automatic performance device which is merely added to a manual tone generation device coupled to a keyboard. According to this type of prior art instrument, a function of producing tones corresponding directly to depressed keys and a function of producing tones for the automatic performance can coexist without sacrificing either one of them. This type of instrument, however, tends to become bulky and expensive and it will be apparently more advantageous in respect of circuit construction and performance functions if circuitries for performing both functions are associated with each other. The instruments described in the above mentioned two United States patent applications has the circuitries for both functions associated with each other but still have the above described disadvantages.

SUMMARY OF THE INVENTION

It is, therefore, an object of this invention to eliminate the above described disadvantages of the prior art electronic musical instruments.

It is another object of the invention to provide an electronic musical instrument capable of producing musical tones without sacrificing either the function of producing tones corresponding directly to the depressed keys or the function of producing tones for the automatic performance.

It is another object of the invention to provide an electronic musical instrument capable of producing tones for a special performance effect such as an automatic arpeggio performance by generating data of the tones for the special performance effect on the basis of data of tones which have already been assigned to some of tone production channels and assigning the generated data to another tone production channel. Since tones used for a special performance effect such as the automatic arpeggio performance are generated on the basis of tones which have already been assigned to some of the tone rproduction channels ordinary production of tones of the depressed keys is never affected even in the case of production of the tones for the special effect. Simultaneously therewith, the tones for the special performance effect are generated. In the foregoing manner, a performance function obtained directly by manipulation on the keyboard (a manual performance function) can coexist with a function for the special performance effect.

It is still another object of the invention to provide an electronic musical instrument in which a tone production channel is exclusively provided for producing the special performance effect such as the automatic arpeggio performance. Data for a tone to be produced in the exclusive tone production channel is generated on the basis of data of a tone of a depressed key which has already been assigned to other tone production channel and the tone related to the generated data is assigned to the exclusive tone production channel. According to the invention, the special performance effect is produced in the exclusive tone production channel so that tone production channels to which production of tones of depressed keys is to be assigned are not sacrificed and a sufficient number of tone production channels are secured. Since the data of the depressed keys are utilized for the special performance effect only after the depressed keys have been assigned to their proper tone production channels, production of tones of the depressed keys is never cancelled.

The special performance effect herein includes the automatic arpeggio performance, an automatic bass performance, an automatic glissando performance and all other musical performance effects to which this invention is applicable.

If the automatic arpeggio, automatic bass or automatic glissando is to be performed, data of the automatic performance tones are generated by selecting note informations (codes) of tones which have already been assigned to respective tone production channels in accordance with a tone generation pattern of the automatic performance to be conducted and adding octave informations to the elected note informations. The data of the automatic performance tone thus generated are timewise sequentially assigned to the exclusive tone production channel and the automatic performance tones are generated by the exclusive tone production channel. The tones of the depressed keys utilized for the automatic performance tones are ready to be also produced as the ordinary performance by the tone production channels to which these tones have been assigned.

BRIEF DESCRIPTION OF THE DRAWINGS

In the accompanying drawings:

FIG. 6 is an explanatory diagram showing one example of an arpeggio pattern.

DETAILED DESCRIPTION OF THE INVENTION

Figure 1:
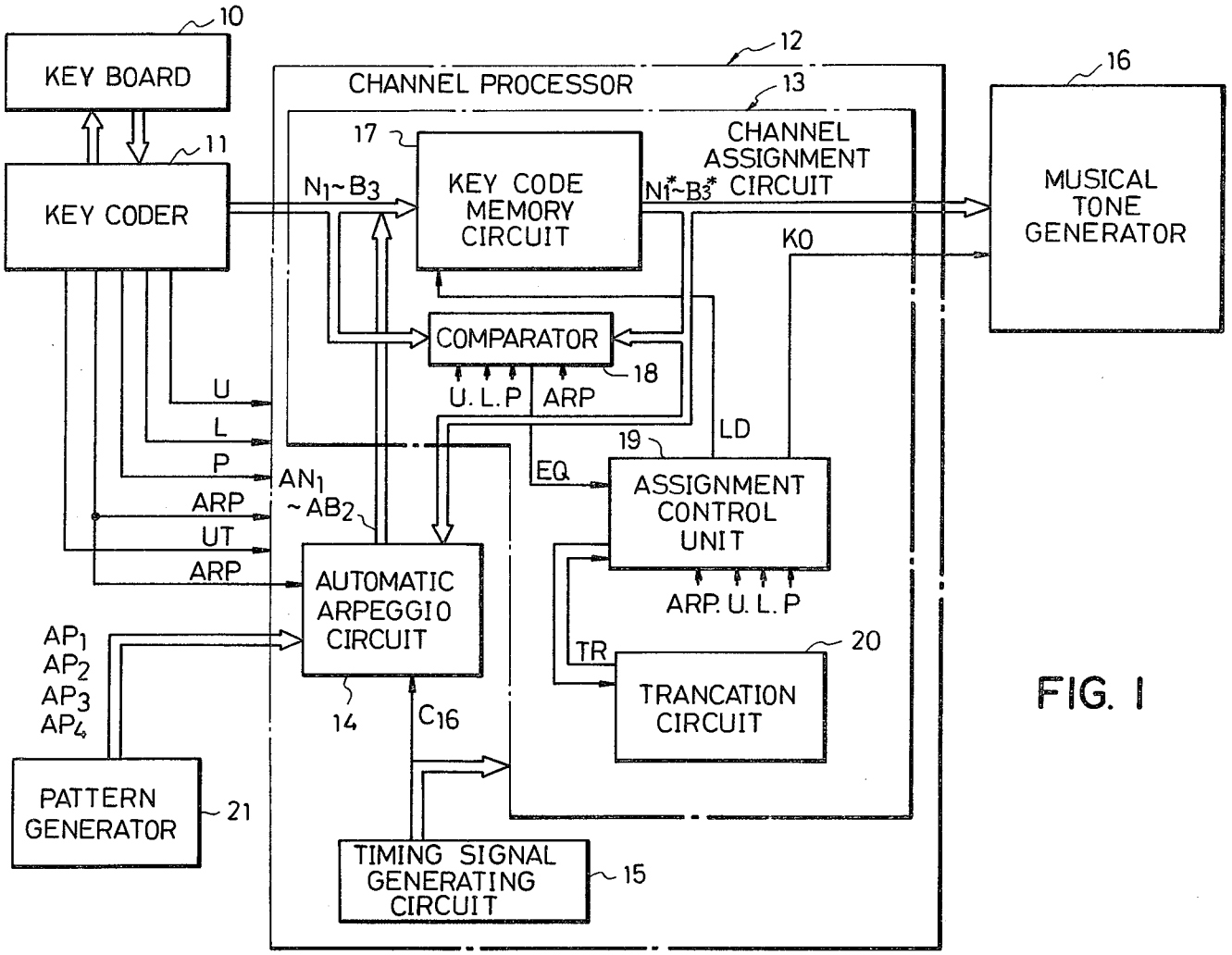
FIG. 1 is a block diagram showing the entire arrangement of one example of an electronic musical instrument according to this invention.

One preferred embodiment of this invention will be described with reference to the accompanying drawings. A special performance effect realized by this embodiment is an automatic arpeggio performance by way of example; however, the technical concept of the invention can be applied to other performance effects.

First, the entire arrangement of an electronic musical instrument to which the technical concept of the invention is applied will be described with reference to FIG. 1.

A keyboard section 10 comprises an upper keyboard, a lower keyboard, a pedal keyboard, and a variety of control switches. A key coder 11 operates to detect the on-off operations of the keys and the switches in the keyboard section 10 to output data representative of the depressed keys and control data representative of the actuated control switches. A channel processor 12 comprises a channel assignment circuit 13, an automatic arpeggio circuit 14, and a timing signal generating circuit 15 for controlling the operation timing of the various circuits included in the channel processor 12.

In this electronic musical instrument, there are provided a predetermined number (fifteen for instance) of tone production channels to which tones concerning the data (key codes $N_1$-$B_3$) representative of depressed keys from the key coder 11 are assigned, and one tone production channel provided only for the special performance effect to which automatic arpeggio tone is assigned. Thus, the number of tone production channels is sixteen (16) in total.

The channel assignment circuit 13 operates to assign production of the tones designated by the key codes $N_1$-$B_3$ (7 bits as hereinafter described) from the key coder 11 to respective ones of the predetermined number (e.g. 15) of the tone production channels, and to assign production of a tone designated by an automatic arpeggio tone key code $AN_1$-$AN_2$ (6 bits as hereinafter described) from the automatic arpeggio circuit 14 to the automatic arpeggio exclusive tone production channel. Hereinafter, the tone production assignment operation which the circuit performs according to the key codes $N_1$-$B_3$ supplied by the key coder 11 will be referred to as "an ordinary assignment operation" when applicable.

A musical tone generator tone 16 is capable of generating each individual musical tone separately with respect to each one of the tone production channels and thus generating musical tones assigned to some of the tone production channels by the channel assignment circuit 13. As the musical tone generator 16, a suitable construction may be employed, e.g. a type wherein musical tones assigned to respective tone production channels are read out in a time division manner from musical tone waveform memories or a type wherein digital tone generators associated with the respective tone production channels are provided in parallel.

In the channel assignment circuit 13, a key code memory circuit 17 has a specific number (e.g. 16) of storage positions corresponding to the number of the tone production channels and gate means provided on the input side. Key code $N_1$-$B_3$ provided by the key coder 11 is stored in one of the storage positions of the key code memory circuit 17 by the "ordinary assignment operation".

The various circuits in the channel assignment circuit section 13 operate mainly for the ordinary assignment operation. A key code comparison circuit 18 compares each key code $N_1$-$B_3$ from the key coder 11 with all the key codes $N_1$*-$B_3$* which have been assigned and stored in the key code memory circuit 17, and produces a comparison output EQ in accordance with coincidence or non-coincidence. An assignment control section 19 detects whether or not predetermined assignment conditions are satisfied and, if these conditions have been satisfied, produces a load signal LD for causing the input key code $N_1$-$B_3$ to be stored in the key code memory circuit 17. When the input key code is stored in the key code memory circuit 17, a new tone production assignment is effected. The control section 19 produces a key-on signal KO representative of the fact that a key assigned to a certain channel is presently being depressed. A truncation circuit 20 detects the channel to which a key released earliest is assigned, and outputs a truncate channel designating signal TR in response to this detection. The assignment control section 19 carries out the control that the old key assignment to the channel designated by the truncate channel designating signal TR is cancelled and a newly depressed key is assigned to that channel.

The automatic arpeggio circuit 14 generates the data (timewise sequentially changing arpeggio key codes $AN_1$-$AB_2$) of tones to be produced in the automatic arpeggio tone production channel according to the data (the output key codes $N_1$*-$B_3$* of the key code memory circuit 17) which has already been assigned to some of the respective tone production channels. More specifically, the automatic arpeggio circuit 14 sequentially selects key codes of depressed keys in a predetermined keyboard, e.g. a lower keyboard, from among the key codes $N_1$*-$B_3$* stored in the key code memory circuit 17 and provides automatic arpeggio key codes $AN_1$-$AB_2$ in response to the key codes $N_1$*-$B_3$* thus selected. The automatic arpeggio key codes $AN_1$-$AB_2$ are outputted as long as the key coder 11 outputs an automatic arpeggio selection signal ARP, and it is applied to the key code memory circuit 17. The key code $AN_1$-$AB_2$ is inputted into the memory position corresponding to the arpeggio tone production channel (the 14th channel) in the key code memory circuit 17 as if a key concerning the key code $AN_1$-$AB_2$ were depressed. As a result, a musical tone corresponding to the key code $AN_1$-$AB_2$ is produced in the automatic arpeggio exclusive tone production channel of the musical tone generating device. The generation patterns of the automatic arpeggio key code $AN_1$-$AB_2$ are designated by an arpeggio pattern signals $AP_1$-$AP_4$. The arpeggio pattern signals $AP_1$-$AP_4$ are outputted by a pattern generator 21, and are selected by the performer to provide various arpeggio patterns.

While the key coder 11 supplies the automatic arpeggio selection signal ARP, the ordinary assignment operation is suspended, and the key coder 11 stops delivering the key codes $N_1$-$B_3$.

Figures 2, 6A, 6B, 6C, 6D:
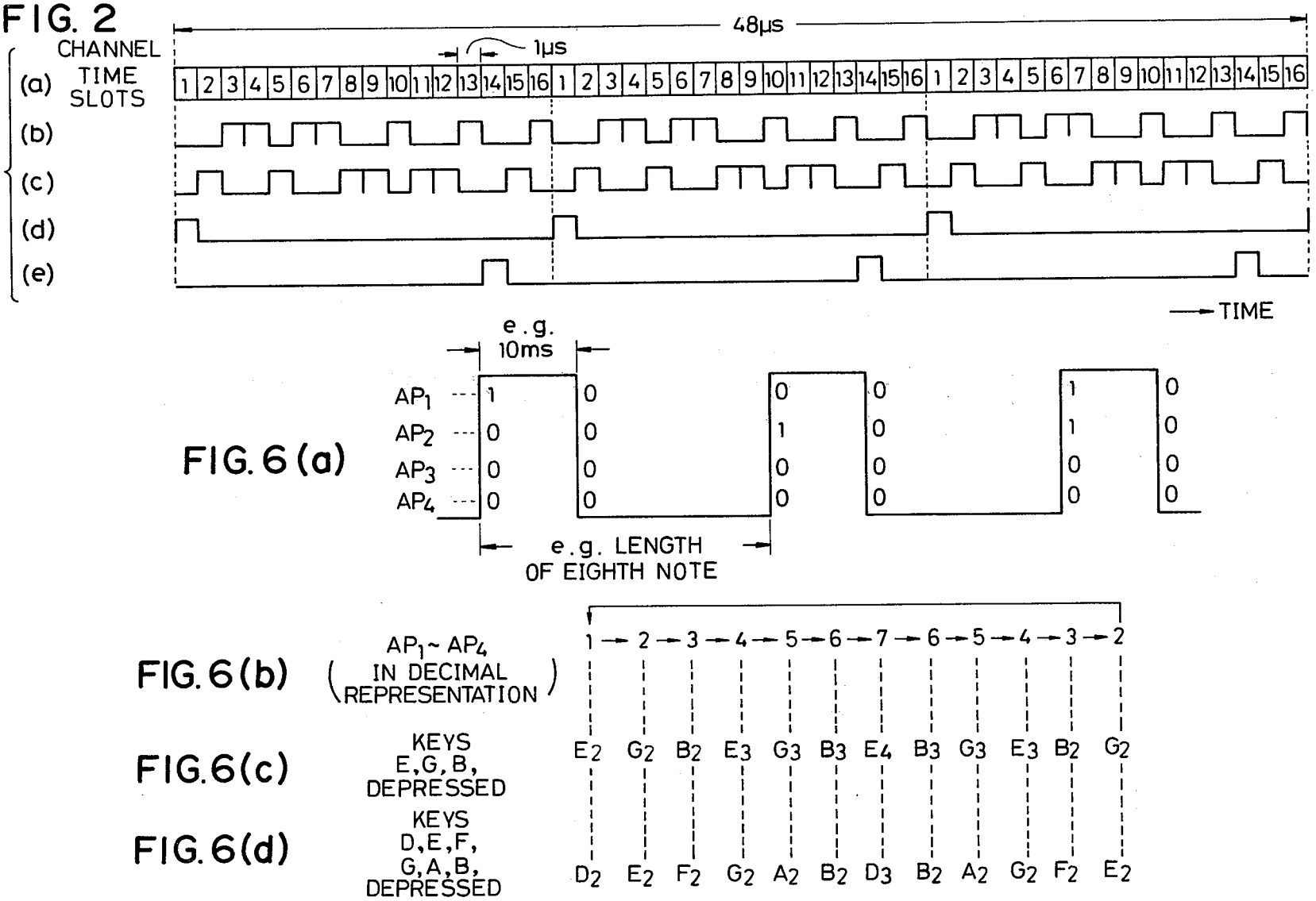
FIG. 2 is a timing chart indicating various timing signals used in a channel processor shown in FIG. 1.

In the channel assignment circuit 13, the tone production channels are formed in time division manner. That is, the tone production channels are formed by time division time slots defined with the timing of a clock pulse having a period of 1 us, as shown in the part (a) of FIG. 2. Sixteen time slots (channel times) each having a time width of 1 us corresponds successively to the first through sixteenth channels.

In this embodiment, the tone production channels are fixedly shared to the respective keyboards, and the channel assignment circuit 13 assigns the depressed keys within a keyboard to the tone production channels among those shared to that keyboard. For instance, the upper keyboard keys are assigned to the 3rd, 4th, 6th, 7th, 10th, 13th and 16th channels (cf. the part (b) of FIG. 2); the lower keyboard keys are assigned to the 2nd, 5th, 8th, 9th, 11th, 12th and 15th channels (cf. the part (c) of FIG. 2); the pedal keyboard keys are assigned to the 1st channel (cf. the part (d) of FIG. 2); and the 14th channel is used for assigning the keys for the automatic arpeggio performance (cf. the part (e) of FIG. 2). Signals representative of channels classified separately according to the keyboards and the special performance are outputted by the timing signal generating circuit 15.

Figure 3:
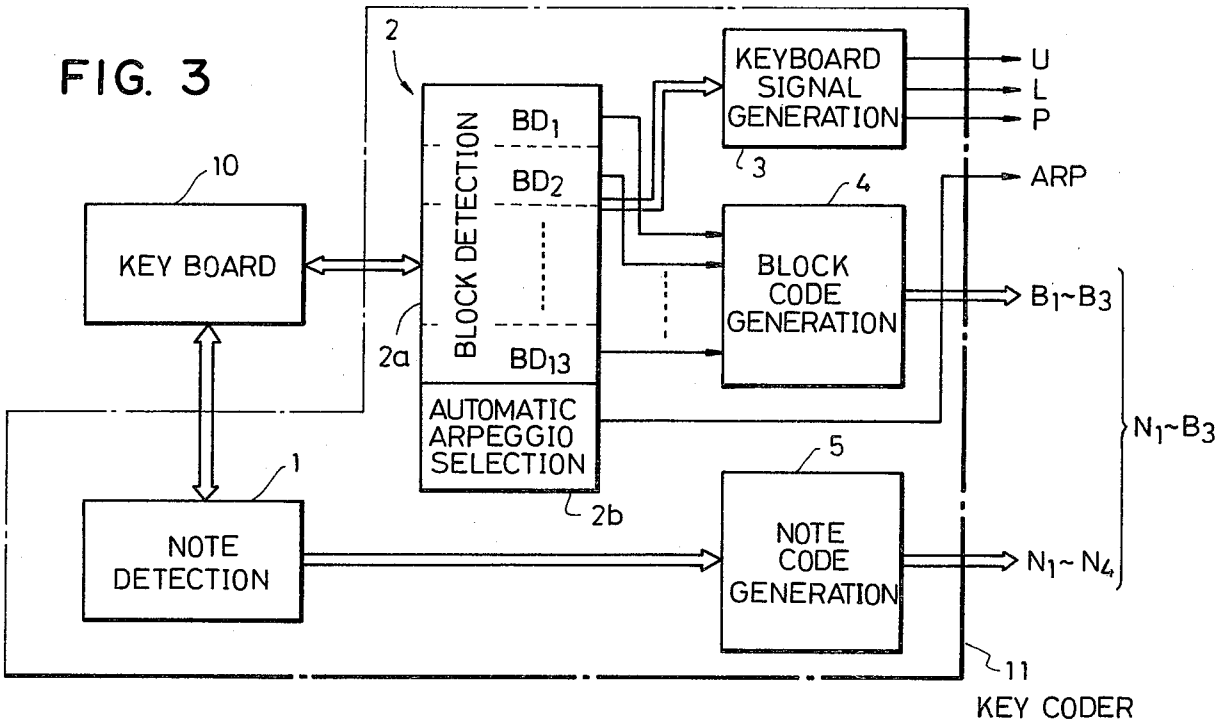
FIG. 3 is a block diagram showing one example of a key coder shown in FIG. 1.

The arrangement of the key coder 11 is as shown in FIG. 3 for instance.

Referring to FIG. 3 a block detection circuit 2*a* of a block detection section 2 detects a block (or a octave range) to which a depressed key in the keyboard section 10 belongs, and extracts the blocks thus detected one after another. A block code generating circuit 4 operates to generate a block code $B_1$, $B_2$ and $B_3$ (3 bits) representative of a block extracted by the block detection circuit 2*a* as long as the note code $N_1$-$N_4$ in the corresponding block is being generated as described later. A note detection circuit 1 detects the note of a depressed key in one block extracted by the block detection circuit 2*a*, and to successively extract the detected notes one after another with a time width of, for instance, 48 μs. A note code generating circuit 5 successively generates the note codes $N_1$, $N_2$, $N_3$ and $N_4$ (4 bits) of the notes which are extracted by the note detection circuit 1, with a time width of 48 μs.

A key code $N_1$-$B_3$ representative of a key is the 7-bit data consisting of the above-described 3-bit block code $B_1$-$B_3$ and 4-bit note code $N_1$-$N_4$. One example of the relations between the contents of the note codes $N_1$-$N_4$ and the notes is indicated in Table 1 below:

TABLE 1

| Note | $N_4$ | $N_3$ | $N_2$ | $N_1$ | Decimal notation |
|---|---|---|---|---|---|
| C# | 0 | 0 | 0 | 1 | 1 |
| D | 0 | 0 | 1 | 0 | 2 |
| D# | 0 | 0 | 1 | 1 | 3 |
| E | 0 | 1 | 0 | 1 | 5 |
| F | 0 | 1 | 1 | 0 | 6 |
| F# | 0 | 1 | 1 | 1 | 7 |
| G | 1 | 0 | 0 | 1 | 9 |
| G# | 1 | 0 | 1 | 0 | 10 |
| A | 1 | 0 | 1 | 1 | 11 |
| A# | 1 | 1 | 0 | 1 | 13 |
| B | 1 | 1 | 1 | 0 | 14 |
| C | 1 | 1 | 1 | 1 | 15 |

One example of the relations between the contents of the block codes $B_1$-$B_3$ and the octave ranges is indicated in Table 2 below:

TABLE 2

| CODE BITS | | | Octave range | | | |
|---|---|---|---|---|---|---|
| $B_3$ | $B_2$ | $B_1$ | Upper keyboard | Lower keyboard | Pedal Keyboard | Arpeggio |
| 0 | 0 | 0 | C3 | C2 | C2 | |
| 0 | 0 | 1 | C#3 . . . C4 | C#2 . . . C3 | C#2 . . . C3 | C#2 . . C3 |
| 0 | 1 | 0 | C#3 . . . C5 | C#3 . . . C4 | C#3 . . . C4 | C#3 . . C4 |
| 0 | 1 | 1 | C#5 . . . C6 | C#4 . . . C5 | | C#4 . . C5 |
| 1 | 0 | 0 | C#6 . . . C7 | C#5 . . . C6 | | C#5 . . C6 |

As is apparent from Table 2, the relations between the block codes $B_1$-$B_3$ and the octave ranges are different from one another separately according to the kinds of keyboard. For instance, the key range of the upper key board is from note C3 to note C7, that is, notes lower in tone pitch than note C3 (note B2 and lower notes) and notes higher in tone pitch than note C7 (note C#7 and higher notes) are not used. The key range of the lower keyboard is from note C2 to note C6. With the same block code, the octave range of the upper keyboard is different by one octave from that of the lower keyboard. The octave range represented by the same block code is not the ordinary octave range of from note C to note B, but the octave range of from note C# to the next higher note C. Accordingly, the block code $B_1$-$B_3$ "0 0 0" in the lowest octave range is applied only to note C which is the lowest note. The column "Arpeggio" in Table 2 indicates octave ranges corresponding to the contents of the block codes $AB_1$, $AB_2$ included in the automatic arpeggio note key codes $AN_1$-$AB_2$ which are provided by the automatic arpeggio circuit 14 (FIG. 1). These octave ranges are roughly similar to those for the block codes $B_1$-$B_3$ for the lower keyboard; however, note C2 in the lowest octave range is not used in automatic arpeggio. Therefore, in the arpeggio block code $AB_1$, $AB_2$, the bit corresponding to the third bit $B_3$ is unnecessary. The key range of the pedal keybord is from note C2 to note C4 and therefor in this case also the data of the third bit $B_3$ is unnecessary.

A keyboard signal generating circuit 3 in the key coder 11 operates to output signals U, L and P which designate the kinds of keyboard to which keys corresponding to key codes $N_1$-$B_3$ belong, in synchronization with the delivery of the key codes $N_1$-$B_3$ (the signals U, L and P designating the upper keyboard, lower keyboard and pedal keyboard, respectively).

A depressed keys code $N_1$-$B_3$ of a depressed key and its keyboard signal U, L or P are produced by the key coder 11 at suitable time intervals. When the key is released, generation of the key code $N_1$-$B_3$ is suspended. In this invention, the process time during which the automatic arpeggio note key code $AN_1$-$AB_2$ is assigned to the exclusive tone production channel is particularly set in the key coder 11. That is, an automatic arpeggio selection circuit *2b* in the block detection section 2 produces the automatic arpeggio selection signal ARP with a time width of 48 μs every 1 ms to 5 ms, and this automatic arpeggio selection signal ARP is used as a signal for designating the above-described process time. For the 48 μs during which the automatic arpeggio selection signal ARP is outputted, none of the key code $N_1$-$B_3$ and the keyboard signals U, L and P are produced.

The arrangement of the block detection section 2 will be described in more detail. The block detection circuit *2a* has positions $BD_1$ through $BD_{13}$ corresponding to, for instance thirteen (13) blocks (if it is assumed that the upper keyboard covers five octaves, the lower keyboard five octaves, and the pedal keyboard three octaves, then thirteen blocks are provided for the octaves, respectively), and the automatic arpeggio selection circuit *2b* is connected to the block position $BD_{13}$. These positions ar priority-connected (preferential network) so that the priority order is set in the order of $BD_1$, $BD_2$–$BD_{13}$. Extraction of the blocks concerning depressed keys is carried out according to the priority order. The automatic arpeggio selection circuit *2b* is also priority-connected to the block positions and the lowest priority order is given to the automatic arpeggio selection circuit *2b*. Accordingly, after one cycle of extraction of the blocks has been completed according to the priority order, in the block detection circuit *2a*, the turn of the automatic arpeggio selection circuit *2b* comes around. When the turn of the automatic arpeggio selection circuit *2b* comes around, the circuit *2b* provides the automatic arpeggio selection ARP. In other words, the automatic arpeggio selection circuit *2b* is like a delay flip-flop connected to the end of the priority connection circuit. Accordingly, when the turn of the automatic arpeggio selection circuit comes around (or when the signal ARP is outputted), the extraction operation of the block detection circuit *2a* has been completed, and the note extraction operation of the note detection circuit 1 in association with the block extraction operation has also been completed. Accordingly, no key code $N_1$-$B_3$ is delivered out. Upon completion of the delivery of the signal ARP, the block detection and extraction and the note detection and extraction are carried out again.

In the manner as described above, the signals $N_1$-$N_4$, $B_1$-$B_3$ and U, L or P representative of depressed keys are successively and repeatedly delivered out with the time width of 48 μs. Furthermore, delivery of the key-depression data $N_1$-p is temporarily suspended every 1 ms to 5 ms, and the automatic arpeggio selection signal ARP is delivered out with the time width of 48 μs.

Figure 4:
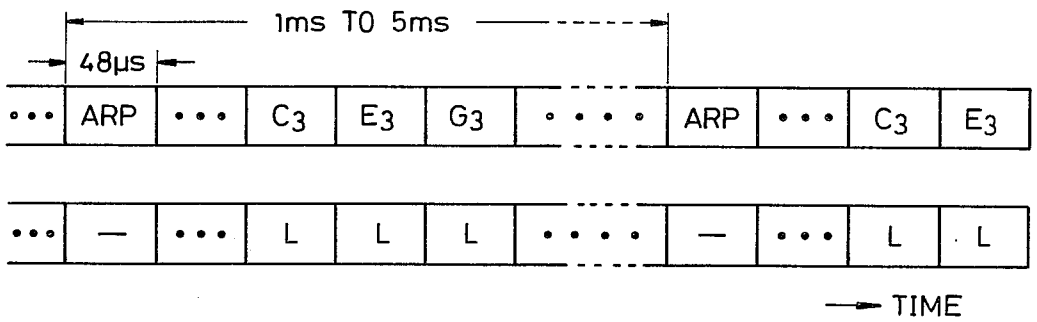
FIG. 4 is a timing chart indicating one example of signals outputted by the key coder in FIG. 3.

Consider the case where three keys corresponding to notes C3, E3 and G3 are depressed in the lower keyboard and the automatic arpeggio performance switch is turned on. In this case, the output of the key coder 11 is as shown in FIG. 4. More specifically, as indicated in the part (a) of FIG. 4, the key codes $N_1$-$B_3$ of notes C3, E3 and G3 are successively delivered out of the key coder 11 with the time width of 48 μs, and the automatic arpeggio selection signal ARP is outputted every 1 ms to 5 ms. This signal ARP lasts for 48 μs, and thereafter the key codes $N_1$-$B_3$ of notes C3, E3 and G3 are repeatedly outputted. In this case, as shown in the part (b) of FIG. 4, the output of the keyboard signal generating circuit 3 is the lower keyboard signal L as long as the key codes $N_1$-$B_3$ of notes C3, E3 and G3 are outputted, and none of the signals are produced by the keyboard signal generating circuit 3 when the arpeggio selection signal ARP is provided.

An up/turn selection signal UT (not shown in FIG. 3) is provided by the key coder 11 in response to a switch operation. The up/turn selection signal UT is to select the tone pitch increment patterns of automatic arpeggio notes or the tone pitch increment and decrement patterns.

The assignment of the key codes $N_1$-$B_3$ and key codes $AN_1$-$AB_2$ to the tone production channels, which is effected when the arpeggio switch is turned on, will be described.

First, it is assumed that the circuitry is in the state that the key codes $N_1$-$B_3$ have been outputted by the key coder 11, or in the state of "ordinary assignment operation".

The key codes $N_1$-$B_3$ of depressed keys are successively outputted by the key coder 11, each having the time width of 48 μs. The key code memory circuit 17 successively outputs the key codes $N_1$*-$B_3$*, which have been assigned already, according to the clock pulse having a period of 1 μs. The key code $N_1$-$B_3$ and the key code $N_1$*-$B_3$* are applied to the comparison circuit 18, where they are compared each other. As was described before, one key code $N_1$-$B_3$ is outputted by the key coder 11 for 48 microseconds. The period of time required for the key code memory circuit 17 to output one series of key codes $N_1$*-$B_3$* for all the channels is 16 microseconds (because one microsecond is provided for each channel, and the total number of tone production channels is sixteen). Therefore, in the comparison circuit 18, one key code $N_1$-$B_3$ is compared with all the key codes $N_1$*-$B_3$* during the 48 microseconds for which the one key code is held therein. The comparison circuit 18 outputs a coincidence detection signal EQ in response to the detection as to whether the same code as the key code $N_1$-$B_3$ is included in the key codes $N_1$*-$B_3$*.

When the assignment control circuit 19 judges from the above-described comparison result that the key code $N_1$-$B_3$ should be stored in the key code memory circuit 17, the assignment control circuit 19 outputs the load signal LD to cause the key code memory circuit 17 to store the key code $N_1$ and $B_3$, whereby a new tone production assignment is carried out. The truncate circuit 20 is to detect a channel to which a key which was released earliest is assigned, and the truncate circuit 20 provides the truncate channel designating signal TR according to this detection. The assignment control section 19 caries, out the control that the old key assignment in the channel designated by the truncate channel designating signal TR is cancelled and a newly depressed key is assigned to that channel.

The "ordinary assignment operation" is carried out as described above.

When the automatic arpeggio selection signal ARP is outputted by the key coder 11, delivery of the key codes $N_1$-$B_2$ by the key coder 11 is stopped, and the automatic arpeggio key codes $AN_1$-$AB_2$ are delivered out by the automatic arpeggio circuit 14. The automatic arpeggio key code $AN_1$-$AB_2$ is supplied to the key code memory circuit 17 as if the key concerning the key code $AN_1$-$AB_2$ were depressed, and it is inputted into the memory position (the 14th channel) corresponding to the arpeggio channel.

Figure 5:
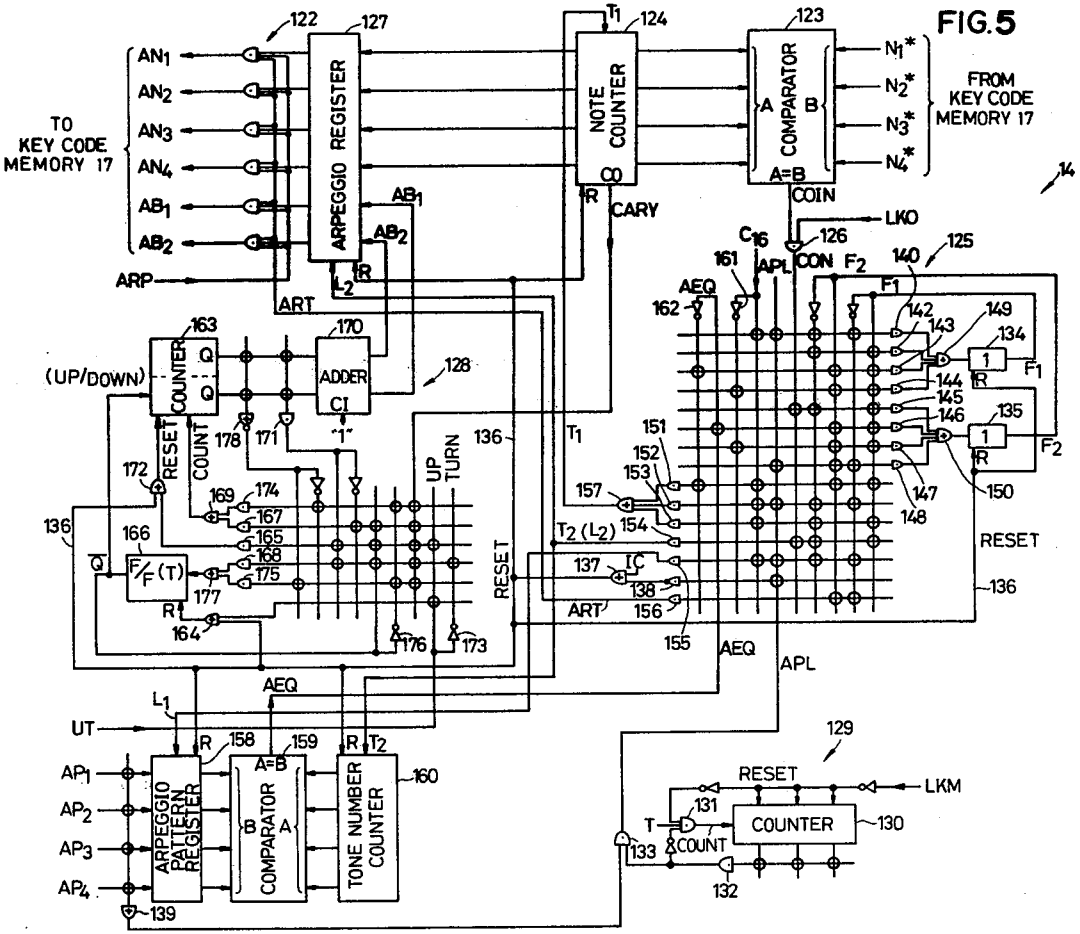
FIG. 5 is a detailed block diagram showing one example of an automatic arpeggio circuit shown in FIG. 1.

A detailed example of the automatic arpeggio circuit 14 is shown in FIG. 5. Among the key codes $N_1$*-$B_3$* stored in the channels of the key code memory circuit 17, the note codes $N_1$*-$N_4$* are inputted to the automatic arpeggio circuit 14, and among these note codes $N_1$*-$N_4$* the note codes $N_1$* -$N_4$* (provided in the 2nd, 5th, 8th, 9th, 11th, 12th and 15th channel times) corresponding to a plurality of keys depressed in a particular keyboard (the lower keyboard for instance) are selected one after another according to an arpeggio pattern. Octave data corresponding to the arpeggio pattern are added to the note codes $N_1$*-$N_4$ thus selected (the block codes $AB_1$ $AB_2$ being added thereto), as a result of which the automatic arpeggio key codes $AN_1$-$AB_2$ are provided. The automatic arpeggio key code $AN_1$-$AB_2$ is selected by an AND circuit group 122 during 48 microseconds for which the automatic arpeggio selection signal ARP is supplied after all the key codes $N_1$-$B_3$ of the depressed keys have been outputted by the key coder 11 each for 48 microseconds (cf. FIG. 4), and the automatic arpeggio key code $AN_1$-$AB_2$ is delivered to the key code memory circuit 17 as if the key of the key code $AN_1$-$AB_2$ were depressed. Then, as was described before, it is stored in the arpeggio channel (the 14th channel) of the key code memory circuit 17.

The note codes $N_1$*-$N_4$ of the tones which have been assigned to the lower keyboard channels are selected by means of a comparator 123. The comparator 123 operates to compare the note code $N_1$*-$N_4$* supplied thereto from the key code memory circuit 17 with the count value of a 4-bit binary counter (note counter) 124, and to output a concidence signal COIN when both of the data coincide with each other. The counter 124 carries out up-count under the control of state control logic 125. The coincidence signal COIN outputted by the comparator 123 is applied to an AND circuit 126, where the coincidence signal COIN which has been provided with respect to the lower keyboard channels is selected with the aid of a lower keyboard key-on-signal LKO. The term "lower keyboard key-on-signal" is intended to mean a signal representative of the fact that a key assigned to the lower keyboard channels is being depressed, the level of the signal being raised to "1" in synchronization with the channel to which the depressed key is assigned. The coincidence signal concerning the lower keyboard channels and selected by the AND circuit 126 will be referred to as a "concidence signal CON" when applicable.

The count value of the note counter 124 obtained when the coincidence signal CON is provided is inputted into a register (arepeggio register) 127. The block code $AB_1$, $AB_2$ formed by an octave control section 128 is simultaneously inputted into the arpeggio register 127. All the data thus inputted into the arpeggio register 127 are not produced as the automatic arpeggio key code $AN_1$-$AB_2$; that is, only the data designated by the state control logic 125 are provided as the automatic arpeggio key code $AN_1$-$AB_2$.

The state control logic 125 comprises two delay flip-flops 134 and 135, and the operations of the various circuits in the automatic arpeggio circuit 14 are controlled by the output states ($F_1$ and $F_2$) of the delay flip-flops 134 and 135.

An arpeggio pattern to be performed is designated by the arpeggio pattern signal $AP_1$-$AP_4$ produced by the pattern generator 21 (FIG. 1). The arpeggio pattern signal $AP_1$-$AP_4$ is 4-bit numerical data. This numerical data indicates, among the notes of keys depressed in the lower keyboard (the notes being assigned to the lower keyboard exclusive channels), the location orders of the notes to be produced as an arpeggio tone, the order being counted from the lowest note among twelve notes in an octave. As is indicated in Table 1, the numerical value of the note code $N_1$-$N_4$ assigned to note C# is the smallest, and the numerical value of the note code assigned to note C is the largest. Accordingly, in this embodiment, note C# is the lowest, the tone pitches of notes D, D#–B are increased in the order named, and note C is the highest within an octave.

FIG. 6 shows one example of generation of the arpeggio pattern signal $AP_1$-$AP_4$ in a certain arpeggio pattern. The time width of generation of the arpeggio pattern signal $AP_1$-$AP_4$ corresponds to the time width of generation (triggering) of one automatic arpeggio tone, being approximately 10 ms, or longer than 10 ms. This time width may be considered as a period of time for which a key is depressed in manual arpeggio performance. The interval of generation of the arpeggio signal $AP_1$-$AP_4$ corresponds to the time length of a note of an automatic arpeggio tone.

In the example shown in the part (a) of FIG. 6, the first arpeggio pattern signal $AP_4$, $AP_3$, $AP_2$, $AP_1$ is "0 0 0 1" which is one (1) in decimal notation, specifying that among the notes of keys depressed in the lower keyboard the first tone from the lowest tone (i.e. the lowest tone itself) should be produced as an automatic arpeggio tone. The second arpeggio pattern signal $AP_4$-$AP_1$ is "0 0 1 0" which is two (2) in decimal notation, specifying that the second tone from the lowest tone should be produced as an automatic arpeggio tone. Thus, the arpeggio pattern signal $AP_1$-$AP_4$ specifies the timing of production of automatic arpeggio tones and the order of the tones of keys depressed in the lower keyboard which are selected for an automatic arpeggio performance.

In fact, the arpeggio pattern signal $AP_1$-$AP_4$ includes, as a result, the octave data of an automatic arpeggio tone. The part (b) of FIG. 6 indicates the values in decimal notation of arpeggio pattern signals $AP_1$-$AP_4$, showing one example of their generation. If this is a phase of arpeggio pattern, the arpeggio pattern signals $AP_1$-$AP_4$ are repeatedly provided in the order as indicated in the part (b) of FIG. 6.

It is assumed that three keys are depressed in the lower keyboard. Then, when the depressed key of the third tone is selected, selection of all of the depressed keys is completed. In this case, the 4th, 5th, 6th and 7th arpeggio tones are obtained by successively increasing the octave of three arpeggio composing tones (depressed keys). That is, in the case where the value of an arpeggio pattern signal $AP_1$-$AP_3$ is larger than the total number of arpeggio composing tones the octave range is increased. Thus, the arpeggio pattern signal $AP_1$-$AP_4$ does not include fixed octave data, but instead the octave data is given to the arpeggio pattern signal as a relative value to the number of depressed keys. In the case where the keys of three notes, E, G and B are depressed, the arpeggio tones obtained according to the pattern shown in the part (b) of FIG. 6 are indicated in the part (c) of FIG. 6. In the case where six notes D, E, F, G, A and B selected, the arpeggio tones obtained according to the pattern shown in the part (b) of FIG. 6 are indicated in the part (d) of FIG. 6. The examples shown in the parts (c) and (d) of FIG. 6 are merely as conductive to an understanding of the invention, and the actual device does not always ,roduce arpeggio tones as indicated in the parts (c) or (d) of FIG. 6.

In the pattern generator 21 (FIG. 1), a variety of arpeggio patterns have been stored, and an arpeggio pattern signal $AP_1$-$AP_4$ corresponding to a necessary arpeggio pattern is outputted in response to the kind of rythm selected by automatic rythm performing device (not shown) built in the electronic musical instrument, the selection of a pattern by the performer, the selection of an up-mode or a turn-mode by the performer, and the number of arpeggio composing tones (depressed keys). The term "up-mode" is intended to mean an arpeggio in which tone pitch increment is repeated, and the term "turn-mode" is intended to mean an arpeggio in which tone pitch increment and decrement are repeated. These modes are designated by the above-described up/turn selection signal UT. That is, when the level of the signal UT is at "1", the up-mode is designated; and when the level of the signal UT is at "0", the turn-mode is designated.

The aforementioned octave switching is controlled by the octave control section 128.

When keys are depressed in the lower keyboard and are assigned to the lower keyboard channels, automatic arpeggio composing tones are prepared and automatic arpeggio tones are produced. However, if the automatic arpeggio circuit 14 is operated before depression of all of desired keys is completed, an unwanted tone or tones may be produced as the arpeggio tones. For instance, if the automatic arpeggio circuit 14 is operated before a key corresponding to the first tone of arpeggio tones is depressed, the second tone is produced as the first tone, as a result of which the arpeggio performance starts in a strange manner. This is due to the fact that the key depression by the performer is fluctuated and the automatic arpeggio circuit 14 operating in the order of microseconds can respond to this fluctuation. In order to overcome this difficulty, or in order to prevent the automatic arpeggio circuit 14 from operating in the initial period of depression of a key, a wating time setting circuit 129 is provided.

Applied to the wating time setting circuit 129 is a lower keyboard memory signal LKM which is a signal whose level is "1" in a DC mode if a key is being depressed in the lower keyboard. When none of the keys in the lower keyboard are depressed, the signal LKM is applied as a reset signal to a 3-bit binary counter 130 to reset the latter 130. If a key is depressed in the lower keyboard, the signal LKM is raised to "1" to release the reset state of the counter 130 and to enable an AND circuit 131. As a result, a count pulse T is applied through the AND circuit 131 to the counter 130, where it is counted. When seven pulses T are applied to the counter 130, the output of the counter 130 becomes "1 1 1", and an AND circuit 132 outputs a signal "1". As a result, the AND circuit 131 is disabled, and the counter 130 holds the state of "1 1 1". When the output of the AND circuit 132 is raised to "1", an AND circuit 133 is enabled.

The output of the AND circuit 133 is maintained at "0" for the period of time (5 to 10 ms for instance) corresponding to seven pulses T after the first key depression in the lower keyboard. When this output signal APL of the AND circuit 133 is at "0", the state control logic 125 is not operated, and therefore the automatic arpeggio circuit 14 is not operated. During this period, keys depressed in a fluctuation manner but substantially simultaneously in the lower keyboard are assigned to the respective tone production channels. Thus, after all of the tones required for the automatic arpeggio performance have been assigned to the lower keyboard channels, the automatic arpeggio circuit 14 is operated.

Delay flip-flop 134 and 135 in the state control logic 125 have four signal states ($F_1$ and $F_2$)

(1) Standby State $ST_0$

When the signal $F_1$, $F_2$ is "0 0", the standby state $ST_0$ is established. In this case, the counters and the memories in the automatic arpeggio circuit 14 are reset to be in standby state. For instance, when the power switch is turned on an initial clear signal TC is applied through an OR circuit 137 to a reset line 136, as a result of which the delay flip-flops 134 and 135 and the relevent counters and memories are reset. When no key is depressed in the lower keyboard, the output signal APL of the AND circuit 133 is at "0", and the reset signal "1" is applied to the reset line 136 through a NAND circuit 138 and the OR circuit 137. Thus, the signal $F_1$, $F_2$ is set to "0 0" (standby state $ST_0$) during the initial period. One example of the states of the signal $F_1$, $F_2$ is indicated in the parts (a) and (b) of FIG. 7, and the corresponding state names ($ST_0$ through $ST_3$) are indicated in the part (c) of FIG. 7.

When the arpeggio pattern signal $AP_1$-$AP_4$ is supplied after it has passed the wating time of the above-described waiting time setting circuit 129 (the AND circuit 133 being enabled), the output of an OR circuit 139 is raised to "1", and the output signal APL of the AND circuit 133 is also raised to "1". Accordingly, the signal APL (hereinafter referred to as "an arpeggio tone production timing signal" when applicable) is maintained at "1" for the period of time during which one arpeggio pattern signal $AP_1$-$AP_4$ is supplied. When the arpeggio tone production timing signal APL is at "1", the output of the NAND circuit 138 is set to "0", and the reset signal of the reset line 136 is set to "0". Accordingly, when an arpeggio pattern signal $AP_1$-$AP_4$ is supplied, i.e. when one automatic arpeggio tone should be produced, the automatic arpeggio circuit 14 is operated.

Figure 7:
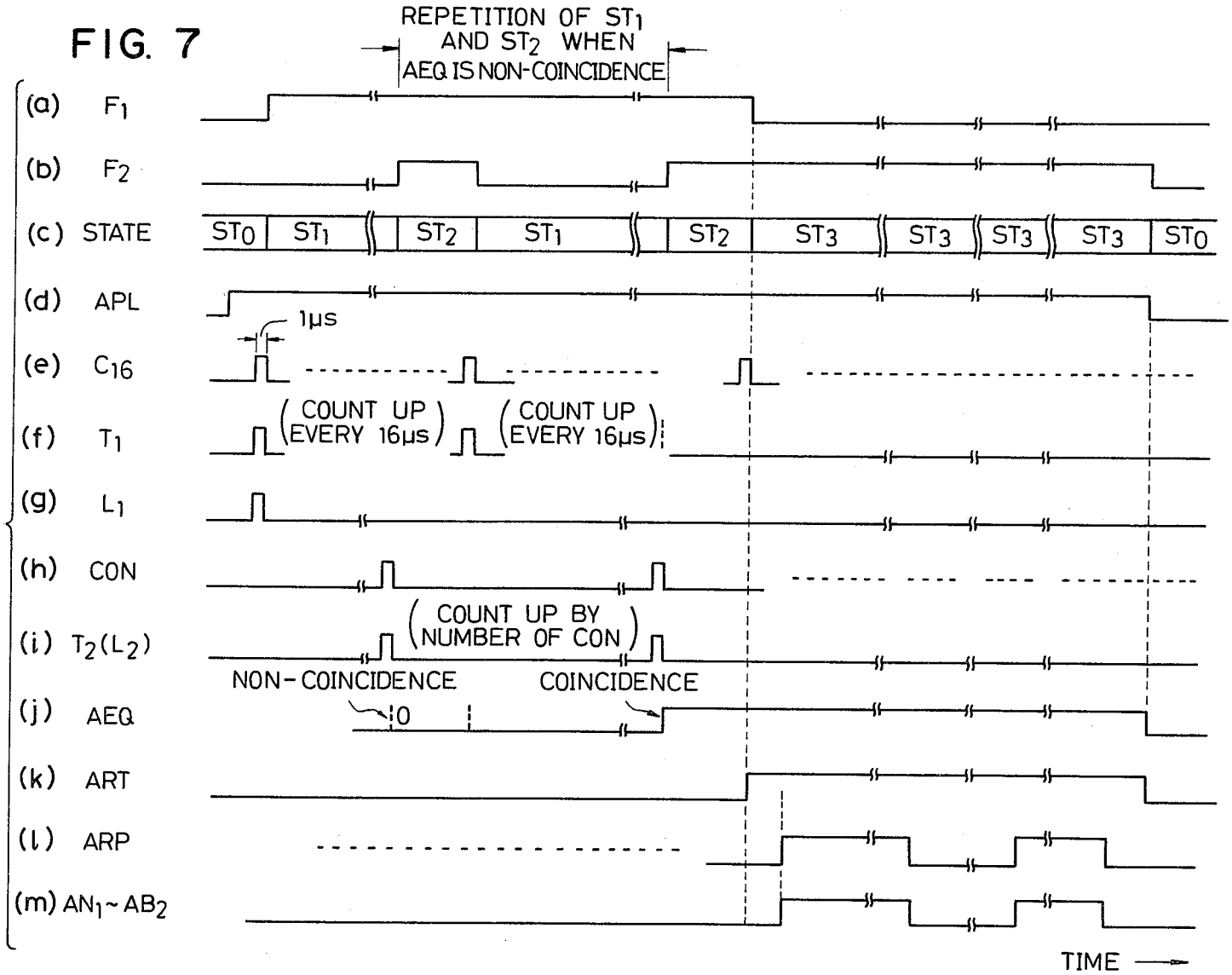
FIG. 7 is a timing chart for a description of the operation of a state control logic shown in FIG. 6.

When, in the standby state $ST_0$, the arpeggio tone production timing signal APL is produced (cf. the part (d) of FIG. 7) and a signal $C_{16}$ having a period of 16 μs and a time width of 1 μs (cf. the part (e) of FIG. 7) is produced, the condition of an AND circuit 140 in the state control logic 125 is satisfied, and a signal "1" is inputted into the delay flip-flop 134 through an OR circuit 149. At the same time, the condition of an AND circuit 125 is satisfied, as a result of which a count pulse $T_1$ is produced by an OR circuit 157 (cf. the part (f) of FIG. 7), and the count value of a note counter 124 is increased by one (1). Simultaneously, the condition of an AND circuit 155 is satisfied, and therefore a load signal $L_1$ is applied to an arpeggio pattern register 158 (cf. the part (g) of FIG. 7). As a result, the arpeggio pattern signal $AP_1$-$AP_4$ is stored in the arpeggio pattern register 158. One microsecond later, the signal $F_1$ is raised to "1", and the standby state $ST_0$ is shifted to the first state $ST_1$.

(2) The First State $ST_1$

When the signal $F_1$, $F_2$ is "1 0", the first state $ST_1$ is established. In the first state $ST_1$, whenever the signal $C_{16}$ is provided, the condition of an AND circuit 153 is satisfied, and the count pulse $T_1$ is applied through the OR circuit 157 to the note counter 124. In the first state $ST_1$, the condition of an AND circuit 142 is satisfied at all times, and therefore the memory signal "1" is held in the delay flip-flop 134. Accordingly, the signal $F_1$, $F_2$ is maintained at "1 0", and the first state $ST_1$ is maintained.

In the first state $ST_1$, the count value of the note counter 124 is increased with the timing of the signal $C_{16}$, every 16 microseconds, and the count value of the note counter 124 is compared with the note code $N_1$*-$N_4$* supplied in time division manner from the key code memory circuit 17 in the comparator 123. As the data of each of the channels (sixteen channels in total) are provided every one microsecond, the count value of the note counter 124 which is maintained unchanged for 16 microseconds is compared with the note codes $N_1$*-$N_4$ of all the channels during 16 microseconds. When the count value of the note counter 124 coincides with a note code $N_1$*$N_4$* of the lower keyboard tone, the coincidence signal CON is provided an AND circuit 126 (cf. the part (h) of FIG. 7) and is applied to the state control logic 125.

As the count value of the note counter 124 is increased starting with "0 0 0 0", the coincidence signals CON are produced starting with the note code $N_1$*-$N_4$* (the first note) on the lower note side. When one coincidence signal CON is provided, the condition of an AND circuit 145 is satisfied, and a signal "1" is inputted through an OR circuit 150 into the delay flip-flop 135. At the same time, the condition of an AND circuit 154 is satisfied, a count pulse $T_2$ is supplied to a 4-bit binary counter (note number counter) 160 while a load signal $L_2$ is applied to the arpeggio register 127 (the part (i) of FIG. 7). As a result, the count value of the note number counter 160 is increased by one (1), while the count value of the note counter 124 which is the same value as that of the note code $N_1$*-$N_4$* and the block code $AB_1$, $AB_2$ supplied from the octave control section 128 are inputted into the arpeggio register 127. The count value of the note number counter 160 represents the order of a note, counted from the lowest note, to which the key code $AN_1$-$AB_2$ stored in the arpeggio register 127 corresponds. One microsecond after this, the output $F_2$ of the delay flip-flop 135 is raised to "1". The signal $F_1$ is maintained at "1" by the AND circuit 142. Therefore, the signal $F_1$, $F_2$ is "1 1". Thus, the first state $ST_1$ is shifted to the second state $ST_2$.

As was described above, in the first state $ST_1$, the count value of the note counter 124 is increased until one coincidence signal CON is provided, and the resultant count value is compared with the note codes $N_1$*-$N_4$*.

(3) The Second State $St_2$

When the signal $F_1$, $F_2$ is "1 1", the second state $ST_2$ is established. In the second state $ST_2$, the contents of the arpeggio pattern signal $AP_1$-$AP_4$ stored in the arpeggio pattern register 158 is compared with the count value of the note number counter 160 in a comparator 159. When both are coincided with each other, a coincidence signal AEQ is produced by the comparator 159. The production of the coincidence signal AEQ means that the key code $AN_1$-$AB_2$ stored in the arpeggio register 127 is the tone of the order designated by the arpeggio pattern signal $AP_1$-$AP_4$.

The second state $ST_2$ is maintained until the next signal $C_{16}$ is provided through AND circuits 144 and 147. In other words, as a signal $\overline{C_{16}}$ obtained by inverting the signal $C_{16}$ by an inverter 161 and the signals $F_1$ and $F_2$ are applied to the AND circuits 144 and 417, the conditions of the AND circuits 144 and 147 are maintained satisfied until the time instant which is immediately before the signal $C_{16}$ is produced in the second state $ST_2$ ($F_1$, $F_2$ being "1 1"). The outputs of the AND circuits 144 and 147 are applied to the delay flip-flops 134 and 135, respectively.

First, the case where the count value of the note number counter 160 is not coincident with the value of the arpeggio pattern signal $AP_1$-$AP_4$ will be described. In this case, the coincidence signal AEQ is at "0" in the second state $ST_2$ (cf. the part (j) of FIG. 7). A signal $\overline{AEQ}$ obtained by inverting the coincidence signal AEQ by an inverter 162 is at "1", and therefore the condition of an AND circuit 143 is satisfied. Furthermore, the condition of an AND circuit 151 is satisfied with the timing of the signal $C_{16}$. Therefore, the signal "1" is applied through the AND circuit 143 only to the delay flip-flop 134 at the timing of the signal $C_{16}$. One microsecond later, the signal $F_1$ is set to "1", while the signal $F_2$ is set to "0". At the same time, the count pulse $T_1$ is supplied through the AND circuit 151 and the OR circuit 157 to the note counter 124. As a result, the second state is shifted back to the first state $ST_1$. When a single coincidence signal CON is produced in the first state $ST_1$, the first state $ST_1$ is shifted to the second state again, and the above-described process is carried out. Until the coincidence signal is provided, the first state $ST_1$ and the second state $ST_2$ appear alternately. The count value of the note number counter 160 is increased each time the coincidence signal CON is provided.

When the count value of the note number counter 160 coincides with the value of the arpeggio pattern signal $AP_1$-$AP_4$, the comparator 159 outputs the coincidence signal AEQ (cf. the part (j) of FIG. 7). Therefore, the condition of an AND circuit 146 is satisfied, and the signal "1" is applied through the AND circuit 146 only to the delay flip-flop 135 at the timing of the signal $C_{16}$ (at the last timing in the second state $ST_2$). Accordingly, one microsecond later, the signal $F_1$, $F_2$ has "0 1". Thus, the second state $ST_2$ is shifted to the third state $ST_3$.

(4) The Third State $ST_3$

When the signal $F_1$, $F_2$ is "0 1", the third state $ST_3$ is established. In the third state $ST_3$, the condition of an AND circuit 156 is satisfied, and an arpeggio key code generation signal ART is produced (the part (k) of FIG. 7). In the third state $ST_3$, as long as the arpeggio tone production timing signal APL is produced, the condition of an AND circuit 148 is satisfied, and the storage ($F_2$="1") of the delay flip-flop 135 is maintained. Accordingly, while one arpeggio pattern signal $AP_1$-$AP_4$ is supplied, the third state $ST_3$ is maintained, and the arpeggio key code generation signal ART is kept produced.

The arpeggio key code generation signal ART is applied to the AND circuit group 122 to enable the AND circuits. The AND circuit group 122 is gate circuit means which is provided for supplying the key code $AN_1$-$AB_2$ stored in the arpeggio register 127 to the key code memory circuit 17. In this case, the key code $AN_1$-$AB_2$ of an automatic arpeggio tone designated by an arpeggio pattern signal $AP_1$-$AP_4$ is stored in the arpeggio register 127.

The automatic arpeggio selection signal ARP is applied to the other input terminals of the AND circuit group 122 (the part (l) of FIG. 7). As was described before, this signal ARP is to designate the process time in which the automatic arpeggio key code $AN_1$-$AB_2$ is assigned to the tone production channel and is processed. The signal ARP is outputted with a time width of 48 microseconds every 1 ms to 5 ms (cf. FIG. 4. The arpeggio key code $AN_1$-$AB_2$, which can be produced by the arpeggio key code generation signal ART, is supplied to the key code memory circuit 17 only for 48 microseconds with the timing of the automatic arpeggio selection signal ARP (the part (m) of FIG. 7). As was described before, the automatic arpeggio selection signal ARP is repeatedly produced by the key coder 11 at the intervals of the order of 1 to 5 ms. Therefore, one through several automatic arpeggio selection signals ARP are produced while the arpeggio key code generation signal ART is produced.

When one arpeggio pattern signal $AP_1$-$AP_4$ disappears, i.e., when the generation timing of one automatic arpeggio note is over, the arpeggio tone production timing signal APL is set to "0". Thus, the third state $ST_3$ is ended. When the signal APL is set to "0", the output of the NAND circuit 138 is raised to "1"- as a result of which the reset signal is supplied to the reset line 136. As a result, all of the delay flip-flops 134 and 135, the note counter 124, the arpeggio register 127, the arpeggio pattern register 158, the note number counter 16, and the counter 163 in the octave control section 128 are reset. Thus, the third state $ST_3$ is shifted to the standby state $ST_0$.

One automatic arpeggio tone is provided in the above-described manner. Upon application of the next arpeggio pattern signal $AP_1$-$AP_4$, similarly as in the above-described case, the automatic arpeggio key code $AN_1$-$AB_2$ is provided.

The octave control section 128 operates to supply the automatic arpeggio note block code $AB_1$, $AB_2$ to the arpeggio register 127. The octave control section 128, as shown in FIG. 5, comprises OR circuits 164, 169, 172 and 177, a NOR circuit 178, AND circuits 165, 167, 168, 171, 174 and 175, inverters 173 and 176, a flip-flop circuit 166, a counter 163, and an adder 170. The operation of the octave control section 128 is not described, because it is disclosed in U.S. patent application Ser. No. 952,098 entitled "Electronic Musical Instrument with automatic arpeggio performance device" in detail. The concrete examples of the key coder 11 and the channel processer 12 are described in detail in the specifications of U.S. Patent Application No. 940,381 entitled "Key Code Data Generation System" and abovementioned U.S. patent application Ser. No. 952,098, respectively, both assigned to the same assignee as the present case.

What is claimed is:

1. In a polyphonic keyboard instrument of the type having key data generating means for generating key data representing depressed keys in a keyboard, channel assignment means for assigning said key data to available ones of a predetermined number of tone production channels, and means for producing musical tones according to the key data assigned to said channels, improvements which comprise:

means for providing, at suitable time intervals, periods of time in which no key data is provided by said key data generating means and for producing a special performance designating signal in each of said periods of time;

means for providing key data directly specifying musical tones for special performance; and means for supplying said key data of musical tones for special performance to said channel assignment means when said special performance designating signal is produced;

said channel assignment means assigning said key data of musical tones for special performance supplied upon production of said special performance designating signal to a predetermined tone production channel, said producing means thereby producing the musical tone directly specified by said key data assigned to said predetermined tone production channel.

2. An electronic musical instrument as defined in claim 1 wherein said means for providing the key data of musical tones for special performance is a circuit which receives from said channel assignment means key data which has been assigned to the tone production channels for ordinary performance in direct response to key depression and which cooperates with said channel assignment means to form said key data of musical tones for special performance by selecting from among said received key data.

3. An electronic musical instrument as defined in claim 1 wherein said instrument is time-shared and wherein a tone production channel is provided for the exclusive use of the special performance in addition to said tone production channels for ordinary performance, said channel assignment means including a key code memory for storing said key codes and supplying the same in time shared fashion to said tone producing means, said special performance key data beng entered into said key code memory upon occurrence of said special performance designating signal and into a storage position dedicated to said predetermined tone production channel.

4. In a polyphonic keyboard electronic musical instrument in which key codes indicative of selected keys are assigned by a channel assignment circuit to available ones of a set number of time division multiplex tone production channels, said instrument having a musical tone generator, the assigned key codes being supplied in time division multiplex fashion to said tone generator which generates the musical tones designated by said supplied key codes, the improvement comprising:

a key coder, cooperating with said keyboard, for repetitively and consecutively providing to said channel assignment circuit key codes indicative of selected keys, said key coder at certain intervals providing an automatic performance control signal instead of said key codes, said channel assignment circuit assigning said provided key codes to available tone production channels, so that said tone generator will generate tones corresponding to said selected keys, an automatic performance device for providing to said channel assignment circuit key codes for a special performance, said special performance key codes directly specifying corresponding tones to be generated, said channel assignment circuit having a tone production channel dedicated to said automatic performance and, upon occurrence of said automatic performance control signal, accepting said special performance key codes instead of the key codes from said coder and assigning each special performance key code to said dedicated tone production channel, said tone generator thereby receiving each special performance key code assigned to said dedicated tone production channel so as to generate the tones corresponding to said automatic performance key codes in addition to said tones corresponding to said selected keys.

* * * * *